US007506970B2

(12) United States Patent
Mita

(10) Patent No.: US 7,506,970 B2
(45) Date of Patent: Mar. 24, 2009

(54) LIQUID EJECTION HEAD AND IMAGE FORMING APPARATUS

(75) Inventor: Tsuyoshi Mita, Kanagawa (JP)

(73) Assignee: Fujifilm Corporation, Kanagawa (JP)

( * ) Notice: Subject to any disclaimer, the term of this patent is extended or adjusted under 35 U.S.C. 154(b) by 293 days.

(21) Appl. No.: 11/231,105

(22) Filed: Sep. 21, 2005

(65) Prior Publication Data

US 2006/0061632 A1 Mar. 23, 2006

(30) Foreign Application Priority Data

Sep. 22, 2004 (JP) ..... 2004-275855

(51) Int. Cl.
*B41J 2/045* (2006.01)
*B41J 2/05* (2006.01)

(52) U.S. Cl. ..... 347/68; 347/58

(58) Field of Classification Search ..... 347/70, 347/71

See application file for complete search history.

(56) References Cited

U.S. PATENT DOCUMENTS

| | | | | |
|---|---|---|---|---|
| 5,940,099 | A | 8/1999 | Karlinski | |
| 6,099,111 | A | 8/2000 | Chang | |
| 6,439,702 | B1 | 8/2002 | Karlinski | |
| 6,481,074 | B1 | 11/2002 | Karlinski | |
| 6,491,384 | B2 * | 12/2002 | Usui et al. | 347/70 |
| 6,616,270 | B1 | 9/2003 | Miyata et al. | |
| 6,766,567 | B2 | 7/2004 | Karlinski | |
| 2003/0088969 | A1 | 5/2003 | Karlinski | |
| 2003/0206218 | A1 | 11/2003 | Miyata et al. | |

FOREIGN PATENT DOCUMENTS

| | | | | |
|---|---|---|---|---|
| JP | 9-226114 | A | | 9/1997 |
| JP | 09226114 | A | * | 9/1997 |
| JP | 11-138796 | A | | 5/1999 |
| JP | 11-192699 | A | | 7/1999 |
| JP | 2000-127379 | A | | 5/2000 |
| JP | 2000-289201 | A | | 10/2000 |
| JP | 2001-179973 | A | | 7/2001 |
| JP | 2003-512211 | A | | 4/2003 |
| WO | WO-01/30577 | A1 | | 5/2001 |

* cited by examiner

*Primary Examiner*—Luu Matthew
*Assistant Examiner*—Lisa M Solomon
(74) *Attorney, Agent, or Firm*—Birch, Stewart, Kolasch & Birch, LLP

(57) ABSTRACT

The liquid ejection head comprises: a nozzle which ejects a liquid; a pressure chamber which is connected to the nozzle; a common liquid chamber which supplies the liquid to the pressure chamber; a piezoelectric element which causes the pressure chamber to deform; and a liquid supply channel which connects between the common liquid chamber and the pressure chamber, wherein the liquid supply channel passes through an active section of the piezoelectric element.

10 Claims, 9 Drawing Sheets

LIQUID EJECTION HEAD AND IMAGE FORMING APPARATUS

BACKGROUND OF THE INVENTION

1. Field of the Invention

The present invention relates to a liquid ejection head and an image forming apparatus, and more particularly to a liquid ejection head and an image forming apparatus that can simplify liquid flow channels for supplying a liquid to liquid ejection ports, thereby achieving high-speed ejection while supplying liquid efficiently.

2. Description of the Related Art

Conventionally, as an image forming apparatus, an inkjet printer (inkjet recording apparatus) is known, which comprises an inkjet head (liquid ejection head) having an arrangement of a plurality of nozzles (ejection ports) and which records images on a recording medium by ejecting the ink from the nozzles toward the recording medium while causing the inkjet head and the recording medium to move relatively to each other.

In an inkjet printer of this kind, the ink is supplied to pressure chambers from an ink tank via an ink supply channel, and then piezoelectric elements are driven by supplying electrical signals corresponding to the image data to the piezoelectric elements. Therefore, since the diaphragms constituting a portion of each pressure chamber are caused to deform, the volume of the pressure chamber is reduced so as to cause the ink inside the pressure chamber to be ejected from a nozzle in the form of a droplet.

In an inkjet recording printer, one image is formed on a recording medium by combining dots formed by ejecting the ink from the nozzles. In recent years, it has become desirable to form images of high quality on a par with photographic prints, according to inkjet printers. It has been thought that high image quality can be achieved by reducing the size of the ink droplets ejected from the nozzles by reducing the diameter of the nozzles, while also increasing the number of pixels per image by arranging the nozzles at high density.

In order to achieve high density of the nozzles, it is indispensable to devise the composition of the electrical wiring and the ink flow channels suitably. Therefore, conventionally, there have been various proposals for achieving high density of the nozzle arrangement, as well as improving the ink supply efficiency and increasing the printing speed (achieving high-frequency ejection).

For example, it is known that high density of the nozzles can be achieved by providing ink supply channels for supplying ink to the pressure chambers in a diaphragm forming one surface of the pressure chambers, and also forming a common liquid chamber on the rear surface of the diaphragm in such a manner that ink is supplied to the pressure chambers from the common liquid chamber by means of the ink supply channels (see Japanese Patent Application Publication No. 9-226114, for example).

For example, it is also known that the structure of the liquid ejection head can be simplified by providing piezoelectric elements on the surfaces of the pressure chambers opposite to the surfaces on which nozzles are provided; providing a portion of a common liquid chamber for supplying ink on the side adjacent to the piezoelectric elements; and providing a covering on the piezoelectric elements in such a manner that electrodes can be extracted by wire bonding, thin film formation, or the like (see Japanese Patent Application Publication No. 2000-127379, for example).

For example, it is also known that higher density and lower costs can be achieved by disposing piezoelectric actuators on pressure chambers on the nozzle surfaces thereof; adopting a structure in which aluminum plugs pass through laminated layers; and then performing silicon photo-etching to form an inkjet head (see Japanese Patent Application Publication No. 2000-289201, for example).

For example, it is also known that an increased number of nozzles reduced costs and high accuracy can be achieved by providing supply restrictors in a diaphragm; providing an ink supply tank forming an ink supply section on the opposite side of piezoelectric elements from the pressure chambers; forming ink supply ports connecting to the pressure chambers from the ink supply tank and passing through the diaphragm; and causing the ink supply section to act as an insulating sealing cover for the piezoelectric elements and to provide covering and damping functions for the piezoelectric elements (see Japanese Patent Application Publication No. 2001-179973, for example).

For example, it is also known that a porous material having a large number of small internally connected pores, such as a sintered stainless steel member, is used as the ink supply layer so that the ink can pass through the porous material, thereby improving refilling properties, achieving high printing speed and high reliability, and obtaining an inkjet head which has excellent ink preparation characteristics and filtration characteristics for a plurality of types of ink (see Japanese Patent Application Publication No. 2003-512211, for example).

For example, it is also known that interconnection between adjacent pressure chambers can be reduced while suppressing crosstalk by forming a groove formed on the opposite side to the side adjacent to the pressure chamber in at least one position on the surface of a laminated piezoelectric element corresponding to the side wall of a pressure chamber. In this reference, it is described that a nozzle is provided on the side adjacent to the laminated piezoelectric element, and a through hole connecting to the nozzle is provided in the laminated piezoelectric element (see Japanese Patent Application Publication No. 11-138796, for example).

For example, it is also known that high density of nozzles can be achieved by providing a supply channel passing through a diaphragm between two pressure chambers in such a manner that ink is supplied to the respective pressure chambers from a common liquid chamber provided on the upper side of the pressure chamber, while crosstalk (mutual interference) between adjacent nozzles can be prevented by absorbing pressure variations which are caused by reflux from the pressure chambers (see, for instance, Japanese Patent Application Publication No. 11-192699).

As described in Japanese Patent Application Publication Nos. 9-226114, 2000-127379, and 2001-179973, in the case in which a common flow channel (common liquid chamber) or a portion thereof is formed on the opposite side of a piezoelectric body from the diaphragm and the pressure chamber, it is necessary to form a supply channel (supply port) in the diaphragm while disposing only the pressure chamber and the nozzle on the pressure chamber side due to the available space on the pressure chamber side so that the common flow channel passes completely through the diaphragm to the other surface (on the side opposite to the pressure chamber), in order to achieve higher density and a higher ejection driving speed (higher driving frequency). In addition, it is also necessary to install such as the electrical wires for supplying drive signals to the piezoelectric bodies, at high density. However, in this case, since it is required to use a multi-layer flexible cable when the electrical wires are extracted on the same surface as the piezoelectric bodies, then there is a large problem in terms of implementation technology.

In Japanese Patent Application Publication No. 9-226114, it is described that actuators (piezo elements) are arranged at 1440 dpi in one row. In this case, although it is considered to achieve high-density, there is no contemplation of increasing the refilling speed. Therefore, it is difficult to achieve high-frequency driving.

In Japanese Patent Application Publication No. 2000-127379, it is described that a portion of the common liquid chamber (reservoir) is provided on the side adjacent to the piezoelectric elements. However, a portion of the common liquid chamber is naturally situated on the side adjacent to the pressure chambers, and the common liquid chamber is also provided further toward the outer side of the piezoelectric elements than the electrical wiring surface. Therefore, it is not suitable for high density.

In Japanese Patent Application Publication No. 2000-289201, it is described that a piezoelectric actuator is provided on the nozzle side, the IC is unified, and a common liquid chamber is provided on the piezoelectric actuator side (namely, the nozzle side) while electrical wires (aluminum plugs) are formed perpendicularly from the drive circuits. However, the common liquid chamber is formed on the outer side of the piezoelectric actuators, and the aluminum plugs are also formed in positions separate from the piezoelectric actuators and the common liquid chamber so as to pass through the laminated layers. Therefore, since it is required to provide space for forming the plugs, high density is difficult to achieve. In addition, since there is no description relating to the compatibility of IC manufacture and heat treatment or relating to the common liquid chamber, there is no contemplation of increasing the refilling speed.

In Japanese Patent Application Publication No. 2001-179973, it is described that pores for supplying ink are provided in regions in which no piezoelectric elements are situated in a diaphragm made of zirconia. However, since the wiring is situated on the piezoelectric element surface, then it is particularly difficult to adopt a matrix structure to such a shape, and therefore, high density is difficult to achieve.

In Japanese Patent Application Publication No. 2003-512211, it is described that bumps are formed on both faces of insulating positions, and the piezoelectric elements are pressurized by elastic pads so that electrodes are extracted. However, since there is no contemplation of achieving high density, then the connections are also liable to become instable.

In Japanese Patent Application Publication No. 11-138796, it is described that through holes connecting to the nozzles are provided on the side adjacent to the piezoelectric elements. However, there is no description relating to wiring or supply channels, and there is no contemplation of achieving high density or high refilling speed.

In Japanese Patent Application Publication No. 11-192699, it is described that a supply channel is provided in the partition between two pressure chambers. In this case, there is a problem in that the rigidity of the pressure chamber partitions is reduced. In addition, there is no contemplation of achieving high density or high refilling speed.

SUMMARY OF THE INVENTION

The present invention was devised in view of the aforementioned circumstances, an object thereof being to provide a liquid ejection head and an image forming apparatus that high density can be achieved while increasing the rigidity of the partitions between pressure chambers, high-speed ejection and high refilling speed can be achieved, and high-frequency driving (high-frequency ejection) can be achieved.

In order to attain the aforementioned object, the present invention is directed to a liquid ejection head comprising: a nozzle which ejects a liquid; a pressure chamber which is connected to the nozzle; a common liquid chamber which supplies the liquid to the pressure chamber; a piezoelectric element which causes the pressure chamber to deform; and a liquid supply channel which connects between the common liquid chamber and the pressure chamber, wherein the liquid supply channel passes through an active section of the piezoelectric element.

According to the present invention, the flow channel resistance is variable by utilizing the deformation of the piezoelectric element. If ejecting the liquid, the flow channel resistance of the liquid supply path is raised. If refilling the liquid, the flow channel resistance is lowered. Therefore, high-speed ejection and high-speed refilling are possible, and high-frequency ejection can be achieved.

The present invention is also directed to the liquid ejection head wherein: the piezoelectric element is formed on a surface of the pressure chamber opposite to a side adjacent to the nozzle; and the common liquid chamber is disposed on an opposite side to the pressure chamber with respect to the piezoelectric element.

Accordingly, the density of the nozzles can be increased and the rigidity of the partitions between the pressure chambers can be improved while preventing crosstalk between mutually adjacent nozzles. In addition, since the distance from the pressure chamber to the nozzle can be shortened, then it is possible to eject liquids of high viscosity.

The present invention is also directed to the liquid ejection head further comprising: a wire which supplies a signal for driving the piezoelectric element, wherein the wire is erected so as to pass through the common liquid chamber in a perpendicular direction with respect to the piezoelectric element.

Therefore, it is possible to achieve yet higher density by incorporating the positioning of the electrical wires.

The present invention is also directed to the liquid ejection head wherein at least a portion of the liquid supply channel is constituted by at least one of a bendable member and an elastic member.

Accordingly, it is possible to prevent obstruction of the displacement of the diaphragm, while also being able to prevent crosstalk of the pressure waves or residual vibrations.

In order to attain the aforementioned object, the present invention is directed to an image forming apparatus comprising a liquid ejection head which comprises: a nozzle which ejects a liquid; a pressure chamber which is connected to the nozzle; a common liquid chamber which supplies the liquid to the pressure chamber; a piezoelectric element which causes the pressure chamber to deform; and a liquid supply channel which connects between the common liquid chamber and the pressure chamber, wherein the liquid supply channel passes through an active section of the piezoelectric element.

The present invention is also directed to the image forming apparatus wherein: the piezoelectric element is formed on a surface of the pressure chamber opposite to a side adjacent to the nozzle; and the common liquid chamber is disposed on an opposite side to the pressure chamber with respect to the piezoelectric element.

The present invention is also directed to the image forming apparatus further comprising: a wire which supplies a signal for driving the piezoelectric element, wherein the wire is erected so as to pass through the common liquid chamber in a perpendicular direction with respect to the piezoelectric element.

The present invention is also directed to the image forming apparatus wherein at least a portion of the liquid supply channel is constituted by at least one of a bendable member and an elastic member.

According to the present invention, it is possible to obtain an image forming apparatus having excellent ejection efficiency.

As described above, according to the present invention, it is possible to perform high-speed ejection of liquid and high-speed refilling, and high-frequency ejection (high-frequency driving) can be achieved.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DETAILED DESCRIPTION OF THE PREFERRED EMBODIMENTS

Figure 1:
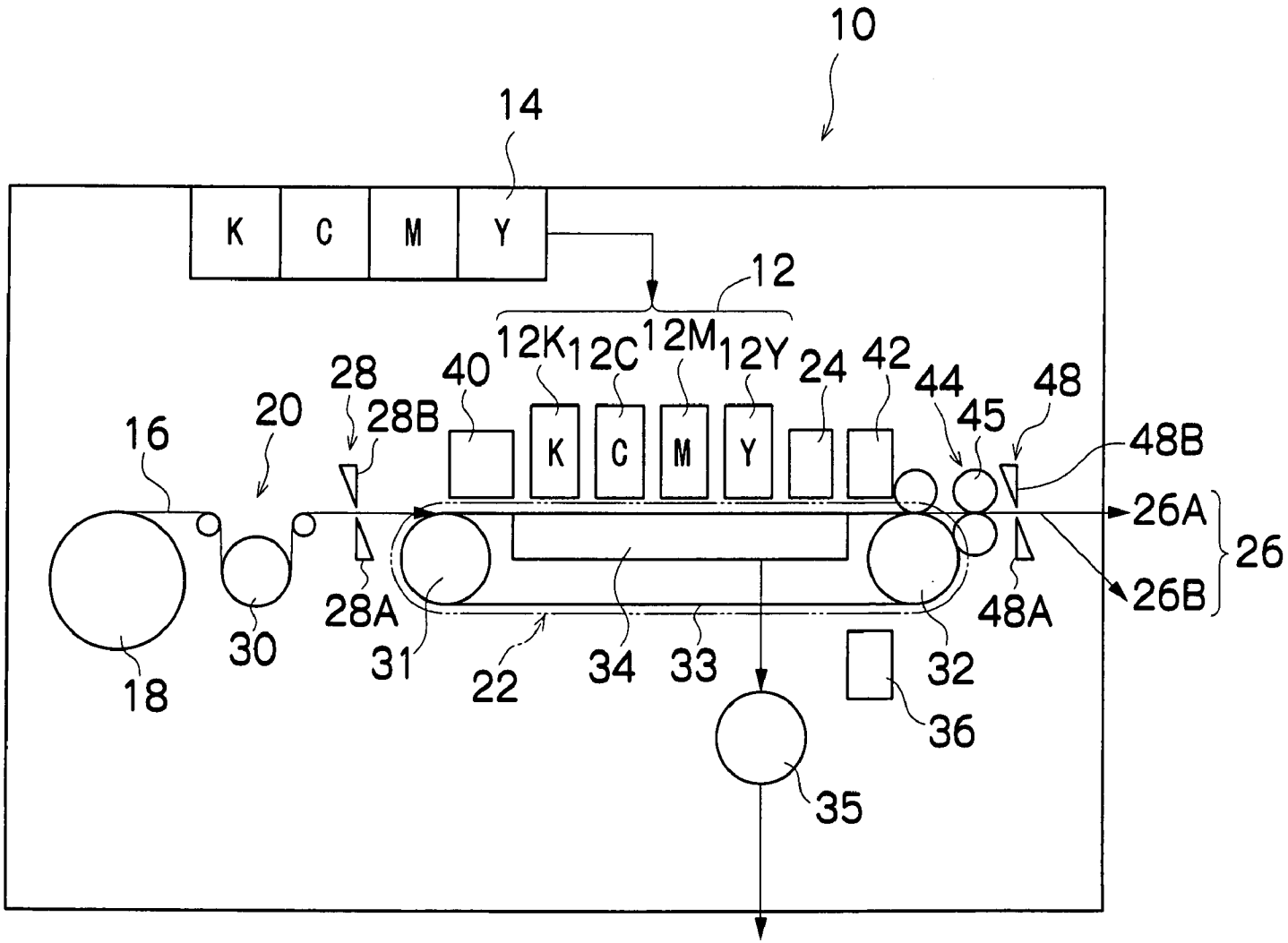
FIG. 1 is a general schematic drawing of an inkjet recording apparatus according to an embodiment of the present invention.

FIG. 1 is a general schematic drawing of an inkjet recording apparatus forming as an image forming apparatus having a liquid ejection head according to an embodiment of the present invention.

As shown in FIG. 1, the inkjet recording apparatus 10 comprises: a printing unit 12 having a plurality of print heads (liquid ejection heads) 12K, 12C, 12M, and 12Y for ink colors of black (K), cyan (C), magenta (M), and yellow (Y), respectively; an ink storing and loading unit 14 for storing inks of K, C, M, and Y to be supplied to the print heads 12K, 12C, 12M, and 12Y; a paper supply unit 18 for supplying recording paper 16; a decurling unit 20 for removing curl in the recording paper 16 supplied from the paper supply unit 18; a suction belt conveyance unit 22 disposed facing the nozzle face (ink-droplet ejection face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a magazine for rolled paper (continuous paper) is shown as an example of the paper supply unit 18; however, more magazines with paper differences such as paper width and quality may be jointly provided. Moreover, papers may be supplied with cassettes that contain cut papers loaded in layers and that are used jointly or in lieu of the magazine for rolled paper.

In the case of a configuration in which roll paper is used, a cutter 28 is provided as shown in FIG. 1, and the roll paper is cut to a desired size by the cutter 28. The cutter 28 has a stationary blade 28A, of which length is not less than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyance path. When cut paper is used, the cutter 28 is not required.

In the case of a configuration in which a plurality of types of recording paper 16 can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet ejection is controlled so that the ink-droplets are ejected in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction restrictors (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and this suction chamber 34 provides suction with a fan 35 to generate a negative pressure, thereby holding the recording paper 16 onto the belt 33 by suction.

The belt 33 is driven in the clockwise direction in FIG. 1 by the motive force of a motor (not illustrated) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not shown, examples thereof include a configuration in which the belt 33 is nipped with cleaning rollers such as a brush roller and a water absorbent roller, an air blow configuration in which clean air is blown onto the belt 33, or a combination of these. In the case of the configuration in which the belt 33 is nipped with the cleaning rollers, it is preferable to make the line velocity of the cleaning rollers different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

Figure 2:
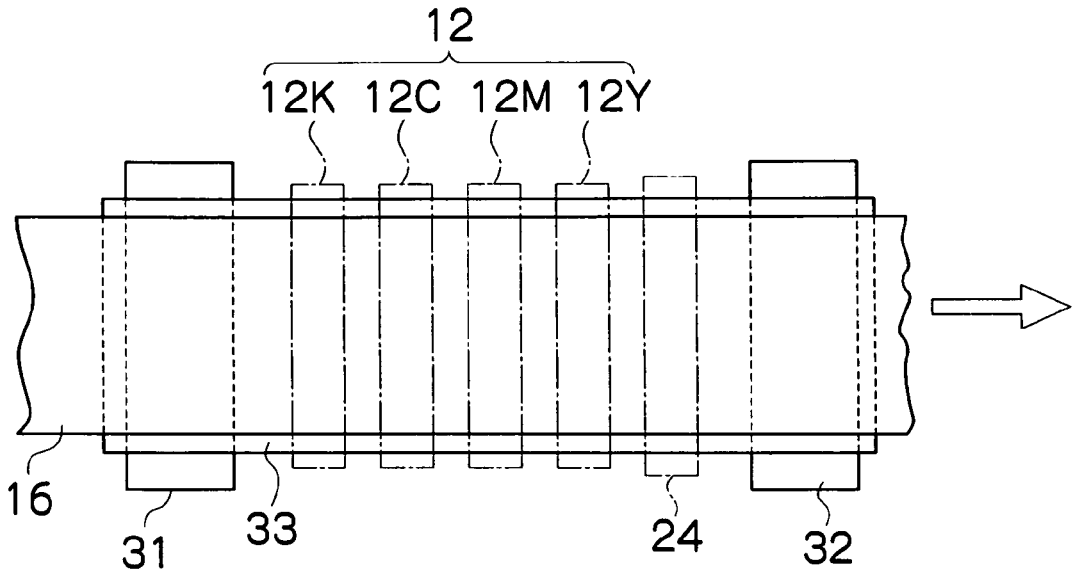
FIG. 2 is a plan view of principal components of an area around a printing unit of the inkjet recording apparatus in FIG. 1.

FIG. 2 is a plan view of principal components of an area around a printing unit 12 of the inkjet recording apparatus 10 in FIG. 1.

As shown in FIG. 2, the printing unit 12 is a so-called "full line head" in which a line head having a length that corresponds to the maximum paper width is disposed in a main scanning direction that is perpendicular to the paper conveyance direction (sub-scanning direction).

Each of the print heads 12K, 12C, 12M, and 12Y is composed of a line head, in which a plurality of ink-droplet ejection apertures (nozzles) are arranged along a length that exceeds at least one side of the maximum-size recording paper 16 intended for use in the inkjet recording apparatus 10, as shown in FIG. 2.

The print heads 12K, 12C, 12M, and 12Y are arranged in the order of black (K), cyan (C), magenta (M), and yellow (Y) from the upstream side (left-hand side in FIG. 1), following the feed direction of the recording paper 16 (hereinafter, referred to as the paper conveyance direction). A color print can be formed on the recording paper 16 by ejecting the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the paper conveyance direction (sub-scanning direction) just once (in other words, by means of a single sub-scan). Higher-speed printing is thereby made possible and productivity can be improved in comparison with a shuttle type head configuration in which a recording head moves reciprocally in a direction (main scanning direction) which is perpendicular to the paper conveyance direction (sub-scanning direction).

Here, the terms "main scanning direction" and "sub-scanning direction" are used in the following senses. More specifically, in a full-line head comprising rows of nozzles that have a length corresponding to the entire width of the recording paper, "main scanning" is defined as printing one line (a line formed of a row of dots, or a line formed of a plurality of rows of dots) in the breadthways direction of the recording paper (the direction perpendicular to the conveyance direction of the recording paper) by driving the nozzles in one of the following ways: (1) simultaneously driving all the nozzles; (2) sequentially driving the nozzles from one side toward the other; and (3) dividing the nozzles into blocks and sequentially driving the blocks of the nozzles from one side toward the other. The direction indicated by one line that is recorded by a main scanning action (the lengthwise direction of the band-shaped region thus recorded) is called the "main scanning direction".

On the other hand, "sub-scanning" is defined as to repeatedly perform printing of one line (a line formed of a row of dots, or a line formed of a plurality of rows of dots) formed by the main scanning, while moving the full-line head and the recording paper relatively to each other. The direction in which sub-scanning is performed is called the sub-scanning direction. Consequently, the conveyance direction of the reference point is the sub-scanning direction and the direction perpendicular to same is called the main scanning direction.

Although a configuration with the four standard colors KCMY is described in the present embodiment, the combinations of the ink colors and the number of colors are not limited to these, and light and/or dark inks can be added as required. For example, a configuration is possible in which print heads for ejecting light-colored inks such as light cyan and light magenta are added.

As shown in FIG. 1, the ink storing and loading unit 14 has tanks for storing inks of the colors corresponding to the respective print heads 12K, 12C, 12M, and 12Y, and each tank is connected to a respective print head 12K, 12C, 12M, and 12Y, via a tube channel (not shown). Moreover, the ink storing and loading unit 14 also comprises a notifying device (display device, alarm generating device, or the like) for generating a notification if the remaining amount of ink has become low, as well as having a mechanism for preventing incorrect loading of the wrong colored ink.

The print determination unit 24 has an image sensor (line sensor) for capturing an image of the ink-droplet deposition result of the printing unit 12, and functions as a device to check for ejection defects such as clogs of the nozzles in the printing unit 12 from the ink-droplet deposition results evaluated by the image sensor.

The print determination unit 24 of the present embodiment is configured with at least a line sensor having rows of photoelectric conversion elements with a width that is greater than the ink-droplet ejection width (image recording width) of the print heads 12K, 12C, 12M, and 12Y. This line sensor has a color separation line CCD sensor including a red (R) sensor row composed of photoelectric conversion elements (pixels) arranged in a line provided with an R filter, a green (G) sensor row with a G filter, and a blue (B) sensor row with a B filter. Instead of a line sensor, it is possible to use an area sensor composed of photoelectric conversion elements which are arranged two-dimensionally.

The print determination unit 24 reads a test pattern image printed by the print heads 12K, 12C, 12M, and 12Y for the respective colors KCMY, and determines the ejection of each print head 12K, 12C, 12M, and 12Y. The ejection determination includes the presence of the ejection, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathways in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, the paper output unit 26A for the target prints is provided with a sorter for collecting prints according to print orders.

Figure 3:
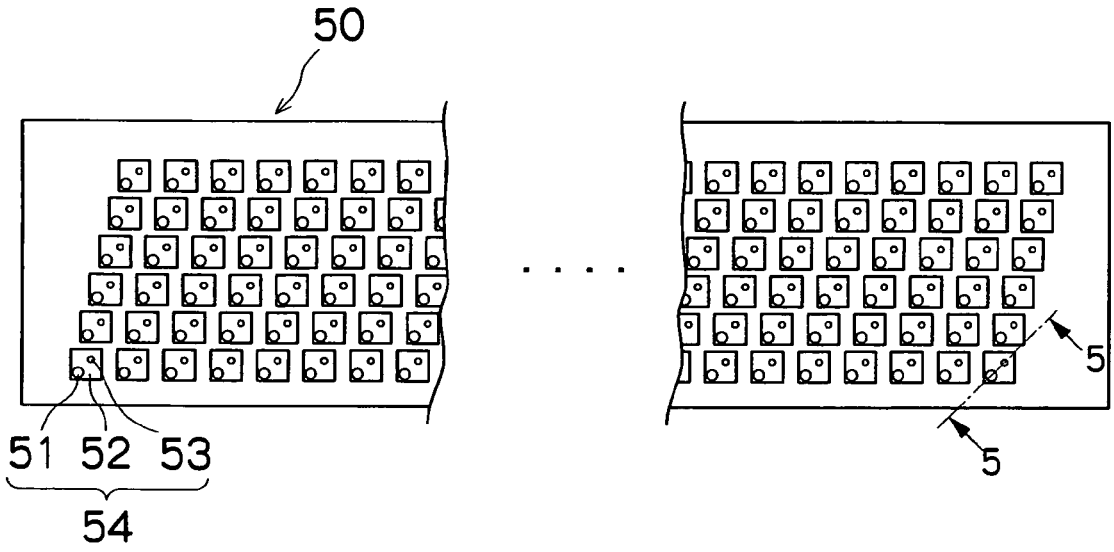
FIG. 3 is a perspective plan view showing an example of configuration of a print head.

Next, the structure of the print heads is described. The print heads 12K, 12C, 12M, and 12Y have the same structure, and a reference numeral 50 is hereinafter designated to any of the print heads 12K, 12C, 12M, and 12Y. FIG. 3 shows a perspective plan view of the print head 50 according to the present invention.

As shown in FIG. 3, the print head 50 according to the present embodiment achieves a high density arrangement of nozzles 51 by using a two-dimensional staggered matrix array of pressure chamber units 54 which are respectively constituted by a nozzle for ejecting ink as ink droplets; a pressure chamber 52 for applying pressure to the ink in order to eject ink; and an ink supply port 53 for supplying ink to the pressure chamber 52 from a common flow channel (not shown in FIG. 3).

There are no particular limitations on the size of the nozzle arrangement in a print head 50 of this kind, but as one example, 2400 npi can be achieved by arranging nozzles 51 in 48 lateral rows (21 mm) and 600 vertical columns (305 mm).

In the example shown in FIG. 3, each of the pressure chambers 52 has an approximately square planar shape when viewed from above, but the planar shape of the pressure chamber 52 is not limited to a square shape. As shown in FIG. 3, a nozzle 51 is formed at one end of the diagonal of each pressure chamber 52, and an ink supply port 53 is provided in the central region thereof.

Figure 4:
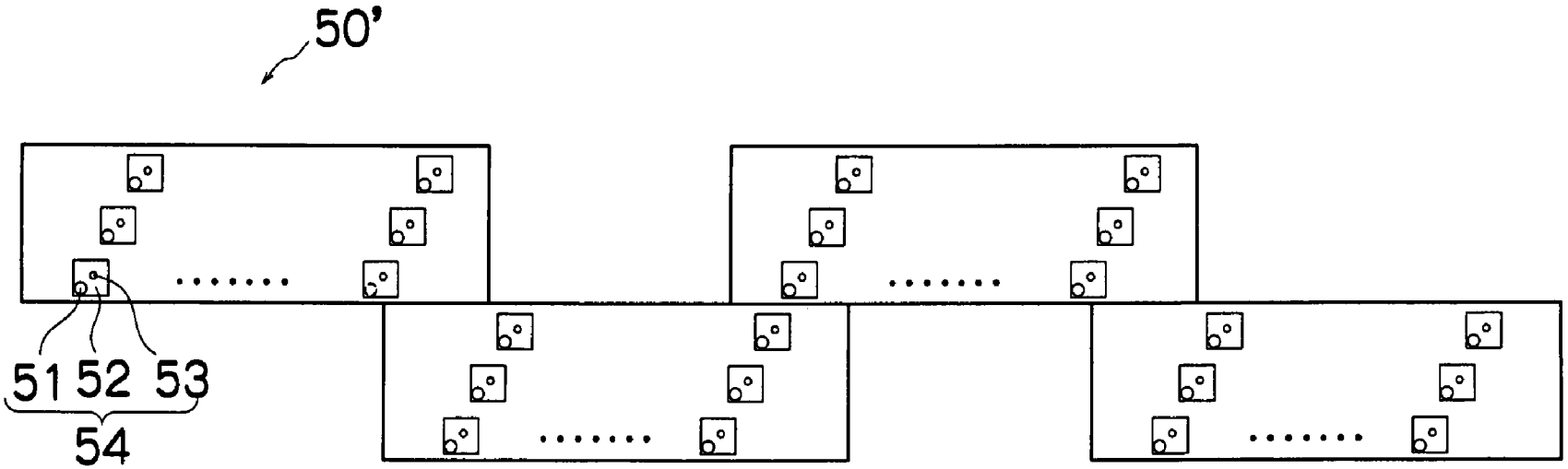
FIG. 4 is a perspective plan view showing another example of configuration of the print head.

FIG. 4 is a perspective plan view showing another example of configuration of a print head. As shown in FIG. 4, one long full line head may be constituted by combining a plurality of short heads 50' arranged in a two-dimensional staggered array, in such a manner that the combined length of this plurality of short heads 50' corresponds to the full width of the print medium.

In the present embodiment, in order to achieve high density in a print head in this way, firstly, a high-density arrangement of nozzles 51 is obtained (for example, 2400 npi) by arranging pressure chambers 52 (nozzles 51) in the form of a two-dimensional matrix as shown in FIG. 3, for example. Next, as described in detail below, a common liquid chamber which supplies ink to the pressure chambers 52 is situated on the upper side of a diaphragm. Then, in order to prioritize ink refilling characteristics, ink supply channels connected to the ink supply ports 53 are formed as a large ink pool so that ink is supplied directly from the common liquid chamber to the pressure chambers 52, which are formed perpendicularly to the diaphragm which constitutes ceiling face of the pressure chambers 52 while the channels passing through the diaphragm. Therefore, since piping which creates flow resistance is eliminated, then the ink supply system is simplified, and a high degree of integration is achieved.

Figure 5:
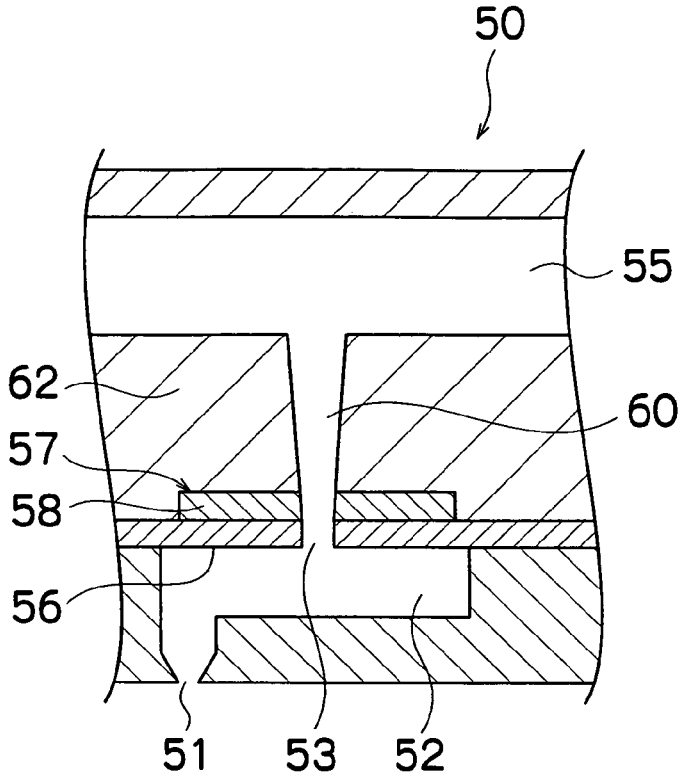
FIG. 5 is a cross-sectional diagram along a line 5-5 in FIG. 3, showing a partially enlarged view of an example of a print head according to a first embodiment of the present invention.

FIG. 5 is a cross-sectional diagram along a line 5-5 of one pressure chamber unit 54 shown in FIG. 3, showing a partially enlarged view of an example of a print head 50 (liquid ejection head) according to a first embodiment of the present invention.

As shown in FIG. 5, in the print head 50 according to the present embodiment, the pressure chamber 52 has a nozzle 51 which ejects ink, and an ink supply port 53 which receives an ink supply. In particular, the ink supply port 53 is formed in the approximate central region of the pressure chamber 52.

Furthermore, the upper surface (ceiling) of the pressure chamber 52 is constituted by a diaphragm 56, and a piezoelectric element 58 which causes the diaphragm 56 to deform by applying a pressure to the diaphragm 56 is bonded on the top of the diaphragm 56. The piezoelectric element 58 is constituted by an electrical-mechanical transducer, such as a piezo (PZT) element which deforms when a voltage is applied, and an electrode (individual electrode) 57 for driving the piezoelectric element 58 is formed on the upper surface thereof. In addition, the diaphragm 56 on the lower side of the piezoelectric element 58 is formed by a thin film of stainless steel, or the like, and it may also be used as a common electrode. When driving the element, a voltage is applied to the piezoelectric element 58 by means of the common electrode (diaphragm 56) and the individual electrode 57.

Moreover, the upper portion of the diaphragm 56 (and the piezoelectric element 58) forms a wiring space 62 for extracting the wires from the individual electrodes 57, and a common liquid chamber 55 which stores ink for supplying to the pressure chambers 52 is provided on the upper side of the wiring space 62.

The ink supply channel 60 is formed through the wiring space 62 in a substantially perpendicular direction to the diaphragm 56, while passing through the piezoelectric element 58 and the diaphragm 56 in an upward direction from the ink supply port 53 provided in approximately central region of the pressure chambers 52, thereby connecting the common liquid chamber 55 and the pressure chamber 52.

The ink supply channel 60 formed in this manner is created perpendicularly in the form of a column from the ink supply port 53 to the common liquid chamber 55. Here, it may also be called an "ink column" due to its shape.

As described above, since the ink supply channel 60 passes through the diaphragm 56 and the piezoelectric element 58, it is necessary that the individual electrode 57 is patterned in such a manner that the ink supply channel 60 is not connected (in other words, without extending from the supply channel hole), in order to prevent shorting between the common electrode (diaphragm 56) and the individual electrode 57 on the piezoelectric element 58. Furthermore, an insulating and protective film is formed on a side in which the wiring space 62 is disposed on the piezoelectric element 58, the individual electrode 57, and the diaphragm 56.

Figure 6:
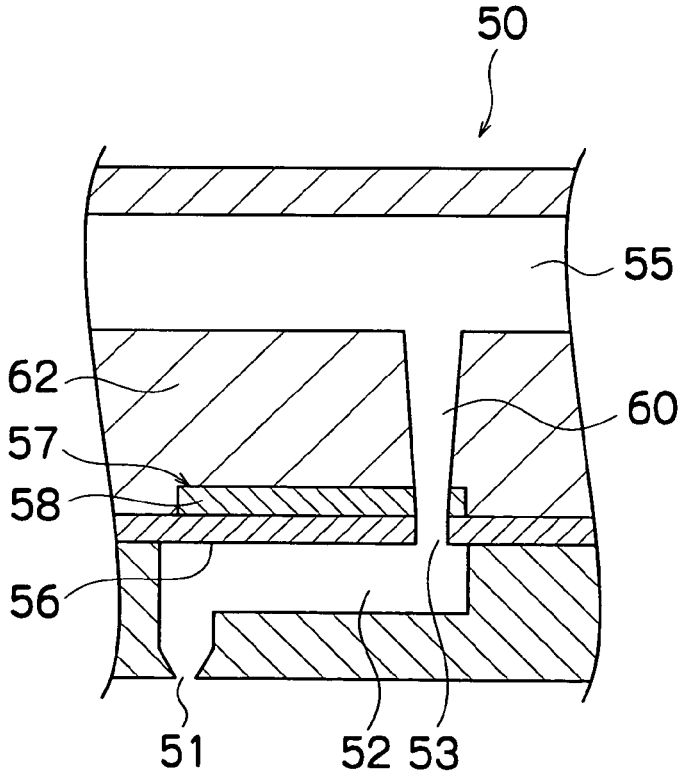
FIG. 6 is an enlarged cross-sectional diagram showing a modification example of a print head according to the first embodiment.

The ink column (ink supply path 60), which is formed perpendicularly from the ink supply port 53 to the diaphragm 56 so as to directly connect the common liquid chamber 55 with the pressure chamber 52, is not limited to being provided in the approximate central region of the pressure chamber 52 as shown in FIG. 5, and it may also be provided in an end section of the pressure chamber 52 as shown in FIG. 6.

FIG. 6 is an enlarged cross-sectional diagram showing a modification example of a print head according to the first embodiment. In FIG. 6, except for only difference in terms of the location of the ink column (ink supply channel 60), the composition is the same as that of the pressure chamber unit shown in FIG. 5 as described above. The position of the ink column (ink supply channel 60) is not limited in particular. However, since the nozzle 51 is provided at the one corner on a diagonal line of the pressure chamber 52, the ink column (ink supply channel 60) is desirably provided at another corner on the diagonal line for achieving a smooth ink flow.

In this case, the ink supply port 53 is provided inside the region (active section) in which the individual electrode 57 is formed on the piezoelectric element 58, rather than over the partition of the pressure chamber 52. In addition, the ink supply port 53 is formed perpendicularly with respect to the diaphragm 56 so as to pass through the diaphragm 56 and the piezoelectric element 58. Therefore, it is possible to reduce the width of the partition between the pressure chambers 52 and hence density can be increased.

Hereinafter, beneficial effects of the first embodiment will be described with reference to FIGS. 7A and 7B.

Figure 7A:
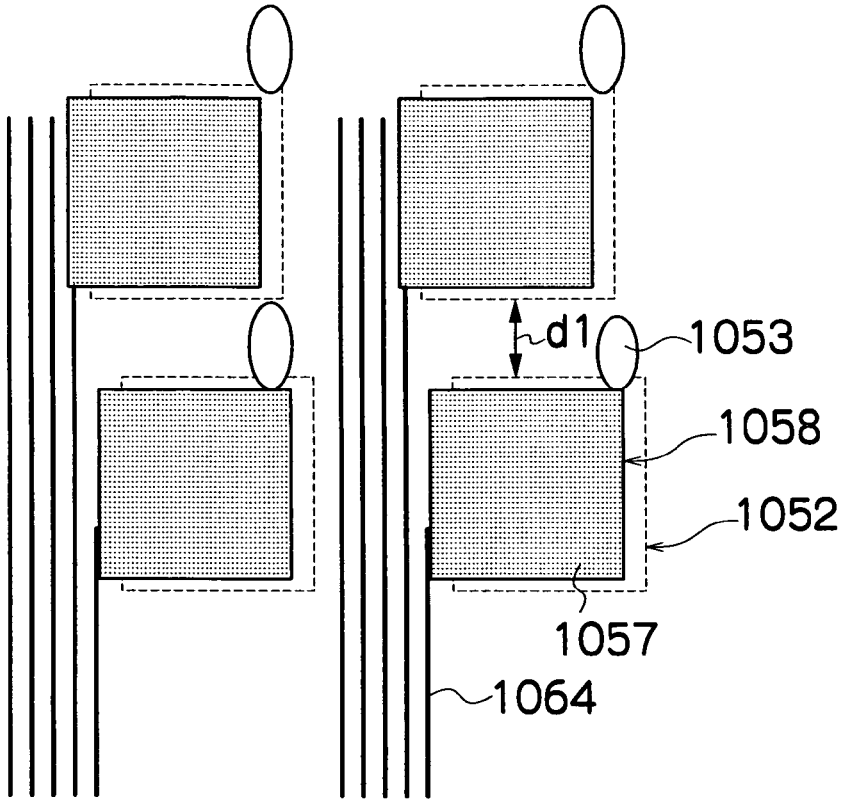
FIGS. 7A and 7B are diagrams for illustrating beneficial effects of the first embodiment, FIG. 7A showing an enlarged plan view of a conventional print head, and FIG. 7B showing an enlarged plan view of a print head according to the first embodiment.
Figure 7B:
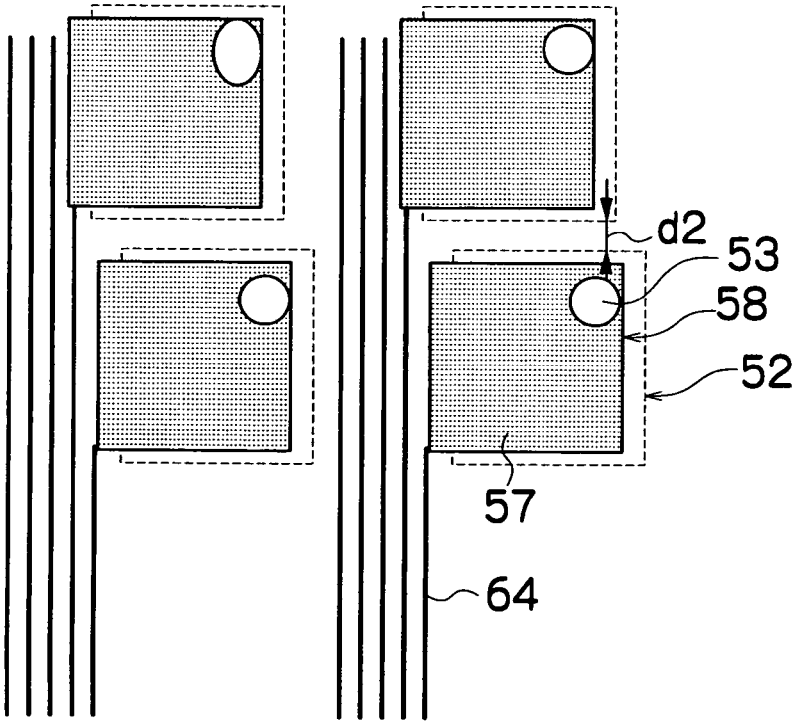

FIG. 7A shows a case in which a conventional ink supply channel is provided inside a lateral partition of the pressure chambers 1052, and FIG. 7B shows a case in which the ink supply channel 60 according to the present embodiment is provided inside the pressure chamber 52 (namely, in the active section of the piezoelectric element) having in the form of an ink column.

As shown in FIG. 7A, conventionally, an ink supply port 1053 is provided in a lateral partition of the pressure chambers 1052. Therefore, since it is necessary that a distance d1 corresponding to the partition is ensured between the pressure chambers 1052, it is impossible to further increase the density. In addition, since the ink supply port 1053 (and the ink supply channel connected to same) is formed inside the partition, the strength of the partition is reduced accordingly. Moreover, the wire 1064 which is wired from the individual electrode (drive electrode) 1057 of the piezoelectric element 1058 causing the pressure chamber 1052 to deform is extracted along the partition between the pressure chambers on the side where the ink supply port 1053 is not formed.

On the other hand, in the present embodiment as shown in FIG. 7B, an ink supply port 53 is provided inside a piezoelectric element 58 (namely, in the active section of the piezoelectric element 58) provided on a pressure chamber 52, and an ink supply channel (ink column) 60 (not shown in FIG. 7B) is formed on top of the ink supply port 53.

Therefore, in the present embodiment, it is possible to reduce the distance d2 between the pressure chambers 52 in comparison with the prior art, and then it is also possible to achieve high density. In addition, since no ink supply channels are formed inside the partitions, the strength of the partitions is improved, even if their width is reduced.

However, as shown in FIG. 7B, the wires 64 wired from the individual electrodes (drive electrodes) of the piezoelectric elements 58 are extracted in a parallel direction to the surface on which the piezoelectric elements 58 are formed, as similar to the prior art shown in FIG. 7A. Therefore, the distance between the pressure chambers 52 is the same as the prior art on the side on which the wires 64 are formed.

In order to achieve yet higher density by reducing the distance between the pressure chambers on the side in which the wiring has been formed conventionally, it is also possible to adopt a structure ("electrical column" structure) in which the wires 64 are formed in a vertical direction which is perpendicularly to the piezoelectric elements 58. This structure will be described hereinafter.

Furthermore, in the present embodiment, the ink supply channels 60 are not provided in the partitions between the pressure chambers 52, as described above. Therefore, the rigidity of the pressure chambers 52 can be increase, and crosstalk between adjacent nozzles 51 can be reduced.

Next, further beneficial effects of the present embodiment will be described with reference to FIGS. 8A and 8B.

Figure 8A:
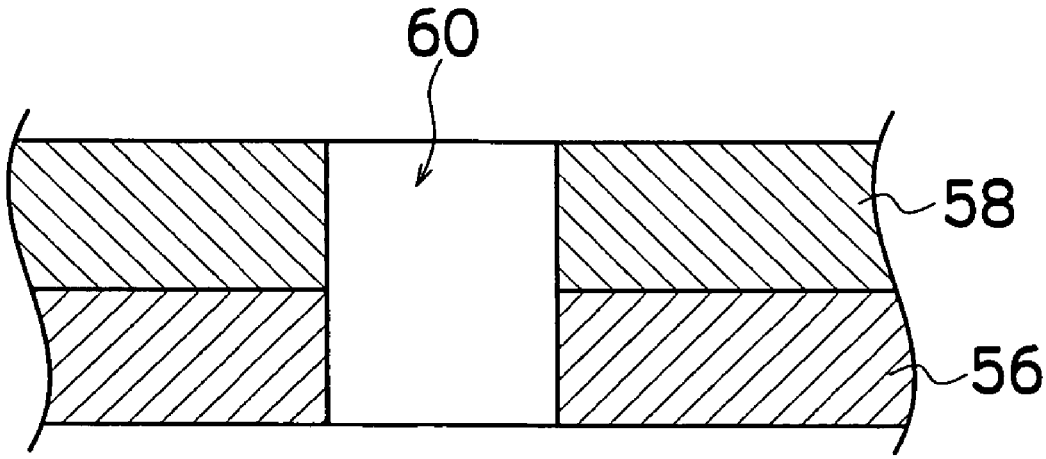
FIGS. 8A and 8B are diagrams for illustrating beneficial effects of the first embodiment, FIG. 8A showing a cross-sectional view of an ink supply channel during non-ejection, and FIG. 8B showing a cross-sectional view of the ink supply channel during ejection.
Figure 8B:
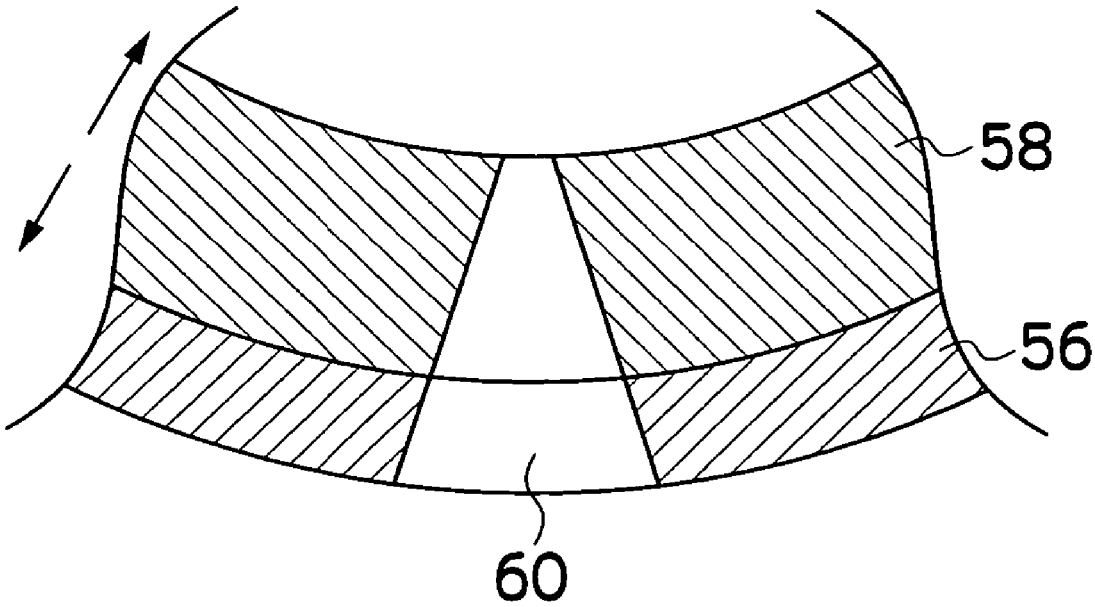

FIGS. 8A and 8B are enlarged views of an ink supply channel 60 formed by passing through the diaphragm 56 and the piezoelectric element 58; FIG. 8A showing a non-ejection state; and FIG. 8B showing an ejection state.

As shown in FIG. 8A, when ejection is not being performed, then the diaphragm 56 and the piezoelectric element 58 are in a flat state, and the diameter of the ink supply channel 60 passing through those is a uniform fat shape.

On the other hand, during ejection, when pressure is applied to the piezoelectric element 58, the piezoelectric element 58 elongates in the direction indicated by the arrow, as shown in FIG. 8B. Therefore, the piezoelectric element 58 and the diaphragm 56 are deformed into a protruding shape in the downward direction of the diagram. Consequently, the portion of the ink supply channel 60 which passes through the piezoelectric element 58 with the diaphragm 56 is broadened on the lower side in the diagram, and becomes narrower on the upper side, thereby increasing the flow resistance and preventing reflux of ink from the pressure chamber 52 to the ink supply channel 60.

After ejection, when the voltage applied to the piezoelectric element 58 is released, the piezoelectric element 58 contracts in the opposite direction to the direction shown by an arrow in FIG. 8B, and then reverts to the state shown in FIG. 8A. Therefore, the portion of the ink supply channel 60 which passes through the piezoelectric element 58 and the diaphragm 56 broadens on the upper side in the diagram, and then becomes a uniformly fat diameter once again. Consequently, since the flow resistance declines, the ink flows rapidly into the pressure chamber 52 from the common liquid chamber 55 through the ink supply channel 60.

As described above, in the present embodiment, since the ink supply channel 60 passes through the piezoelectric element 58 and the diaphragm 56, the portion of the ink supply channel 60 functions as a flow resistance variation device which changes the flow resistance in accordance with the drive state of the piezoelectric element 58. Therefore, it is possible to achieve a valve function. Consequently, since the ink supply channel 60 functions as a valve, it is possible to achieve both high-speed ejection of the ink and high-speed refilling, and therefore, high-frequency driving can be attained.

Incidentally, in the print head 50 according to the first embodiment described above, the piezoelectric element 58 is taken to be a single-plate member, but the piezoelectric element 58 may also be a laminated piezoelectric element, rather than a single-plate member.

Figure 9:
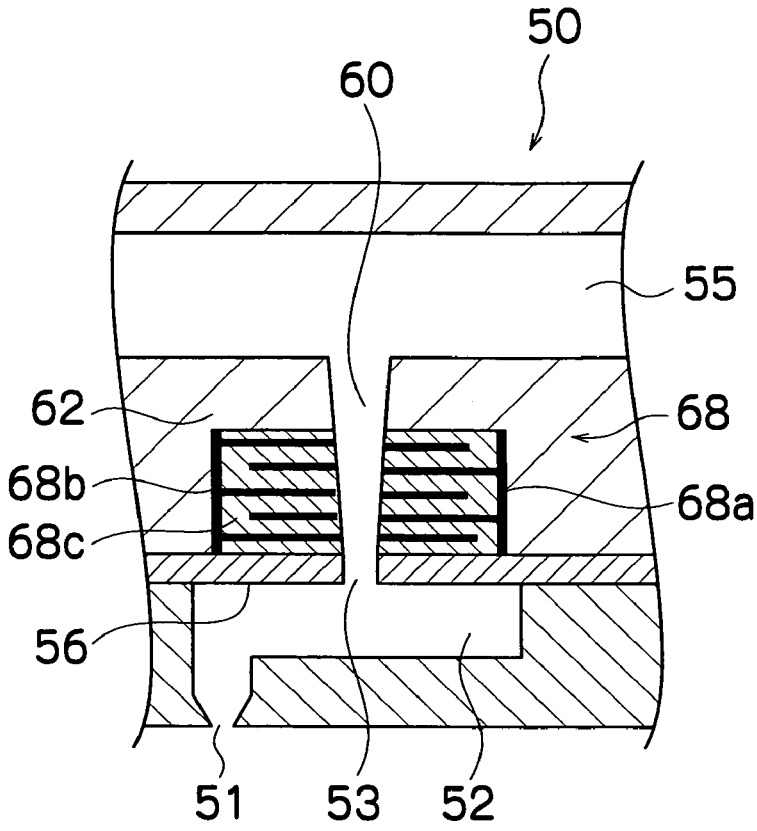
FIG. 9 is an enlarged cross-sectional diagram showing a modification example of a print head according to the first embodiment.

FIG. 9 shows a modification example according to the first embodiment, which is an enlarged cross-sectional view of a print head 50 in which a laminated piezoelectric element 68 is provided as the piezoelectric element.

As shown in FIG. 9, in this modification example, a laminated piezoelectric element 68 is adopted instead of the single-plate piezoelectric element 58 shown in FIG. 5. The laminated piezoelectric element 68 is constituted by laminating common electrodes 68*a* and individual electrodes 68*b* to each other so that the piezoelectric bodies 68*c* are interposed alternately between common electrodes 68*a* and individual electrodes 68*b*.

When a laminated piezoelectric element 68 is used, the portion of the ink supply channel 60 which passes through the laminated piezoelectric element 68 is longer. Therefore, since the deformation effect of this portion is greater, the valve function of the ink supply channel 60 is more effective than the ink supply channel 60 shown in FIGS. 8A and 8B.

Figure 10:
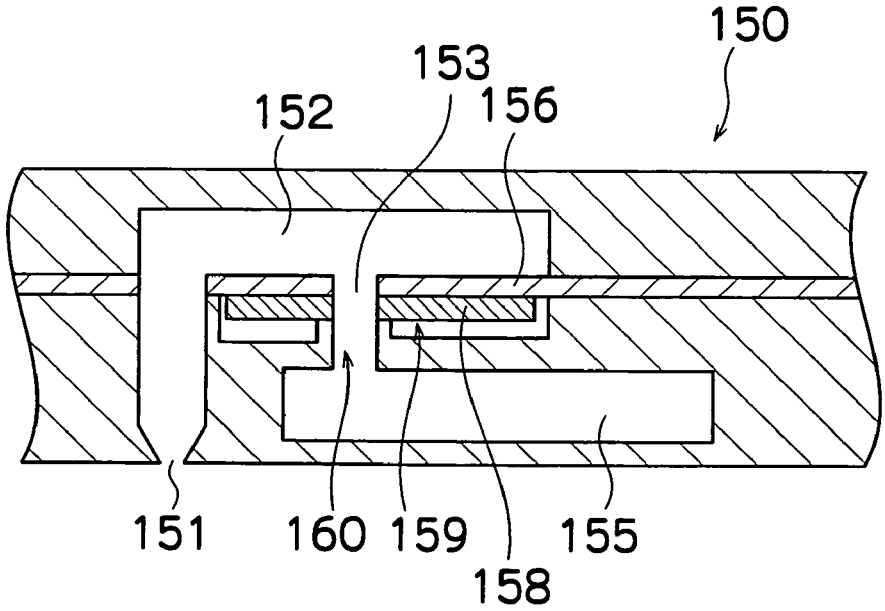
FIG. 10 is an enlarged cross-sectional diagram showing a print head according to a second embodiment of the present invention.

Next, a second embodiment of the present invention will be described. FIG. 10 is a cross-sectional diagram showing the schematic composition of a print head 150 according to the second embodiment.

As shown in FIG. 10, the print head 150 according to the present embodiment includes a pressure chamber 152 connected to a nozzle 151, and the surface of the pressure chamber 152 adjacent to the nozzle 151 (in the diagram, the surface on the lower side, or the under surface) is constituted by a diaphragm 156. A piezoelectric element 158 is bonded to the under side of the diaphragm 156, and a common liquid chamber 155 is disposed below the piezoelectric element 158.

More specifically, the common liquid chamber 155 is formed on the side adjacent to the nozzle 151 with respect to the pressure chamber 152, in other words, it is formed beneath the pressure chamber 152 in the diagram. However, in this embodiment, since the diaphragm 156 and the piezoelectric element 158 are formed to the lower side of the pressure chamber 152, the common liquid chamber 155 is disposed on the opposite side to the pressure chamber 152 with respect to the diaphragm 156 and piezoelectric element 158.

In this case, the ink supply channel 160 which supplies ink from the common liquid chamber 155 to the pressure chamber 152 is formed perpendicularly to the diaphragm 156 so as to pass through the piezoelectric element 158 and the diaphragm 156. The ink supply channel 160 is formed so as to connect the common liquid chamber 155 with an ink supply port 153 provided in the approximate central region of the pressure chamber 152. Furthermore, a gap 159 is provided on the lower side of the piezoelectric element 158, in order to facilitate the deformation of the piezoelectric element 158.

In the present embodiment, since the ink supply channel 160 is also formed perpendicularly with respect to the diaphragm 156 so as to pass through the active section of the piezoelectric element 158 and the diaphragm 156, then it is possible to shorten the distance between pressure chambers 152, thereby being able to achieve the high density.

Furthermore, as similar to the first embodiment, the portion of the ink supply channel 160 has a valve function as a flow resistance variation device. In other words, the flow resistance of the ink supply channel 160 is increased during ejection, while the flow resistance is decreased during refilling. Therefore, high-speed ink ejection and high-speed refilling are possible, and high-frequency driving can be achieved.

Figure 11:
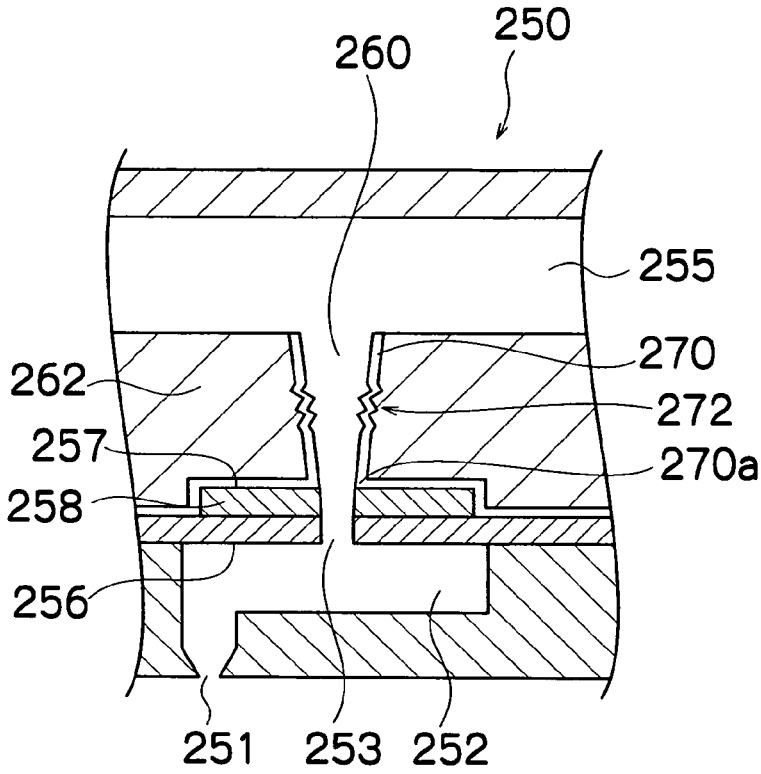
FIG. 11 is an enlarged cross-sectional diagram showing a print head according to a third embodiment of the present invention.

Next, a third embodiment of the present invention will be described. FIG. 11 is a cross-sectional diagram showing schematic composition of a print head 250 according to the third embodiment.

As shown in FIG. 11, the basic structure of the print head 250 according to the present embodiment is similar to the print head 50 according to the first embodiment shown in FIG. 5.

More specifically, the pressure chamber 252 has a nozzle 251 which ejects the ink, and an ink supply port 253 which receives a supply of ink formed in the approximate central region of the pressure chamber 252, as shown in FIG. 11.

Furthermore, the upper surface (ceiling) of the pressure chamber 252 is constituted by a diaphragm 256, and a piezoelectric element 258 is bonded on top of the diaphragm 256, which causes the diaphragm 256 to deform by applying a pressure to the diaphragm 256. An individual electrode 257 for driving the piezoelectric element 258 is formed on the upper surface of the piezoelectric element 258. In addition, the diaphragm 256 is formed by a thin film of stainless steel, or the like, and also serves as a common electrode.

Moreover, a wiring space 262 is formed above the diaphragm 256 (and the piezoelectric element 258), for extracting the wires from the individual electrodes 257. A common liquid chamber 255 is provided on the upper side of the wiring space 262, which stores the ink for supplying to the pressure chambers 252.

The ink supply channel 260 connecting between the common liquid chamber 255 and the pressure chamber 252 is formed by passing through the wiring space 262 in a substantially perpendicular direction to the diaphragm 256 so as to pass through the piezoelectric element 258 and the diaphragm 256 in an upward direction from the ink supply ports 253 provided in approximately the central region of each of the pressure chambers 252.

As described above, the structure of the print head 250 of the present embodiment is similar to that of the print head 50 according to the first embodiment described above. The print head 250 according to the present embodiment differs from the print head 50 according to the first embodiment in that an ink supply channel 260 is formed by a bendable member or elastic member for responding to deformation of the piezoelectric element 258.

More specifically, the member forming the side walls 270 of the ink supply channel 260 is made of a bendable member or elastic member which is able to deform in response to deformation of the piezoelectric element 258. Furthermore, in order to facilitate the deformation of the side walls 270 of the ink supply channel 260, a bellows-shaped section 272 may be formed in the central portion of the ink supply channel 260, for example.

By adopting a composition of this kind, even if the large deformation of the piezoelectric element 258 occurs during driving, the side walls 270 of the ink supply channel 260 expands, thereby responding satisfactorily to the deformation. Therefore, high-speed ejection of ink and high-speed refilling are possible, and high-frequency driving (high-frequency ejection) can be achieved.

Incidentally, the material of the side walls 270 may also have an insulating and protective function for preventing the individual electrode 257 from making contact with the ink, and may serve as a seal for protecting the piezoelectric element 258 and the diaphragm 256.

Next, a fourth embodiment of the present invention will be described. The present embodiment adopts a structure ("ink column") in which the ink supply channels are formed perpendicularly inside the active sections of the piezoelectric elements, passing through the piezoelectric elements and the diaphragm, and it seeks to achieve yet higher density than the above-described first to third embodiments for increasing the density, by forming the electrical wires which supply drive signals to the individual electrodes as "electrical columns" which rise up perpendicularly directly above the individual electrodes.

Figure 12:
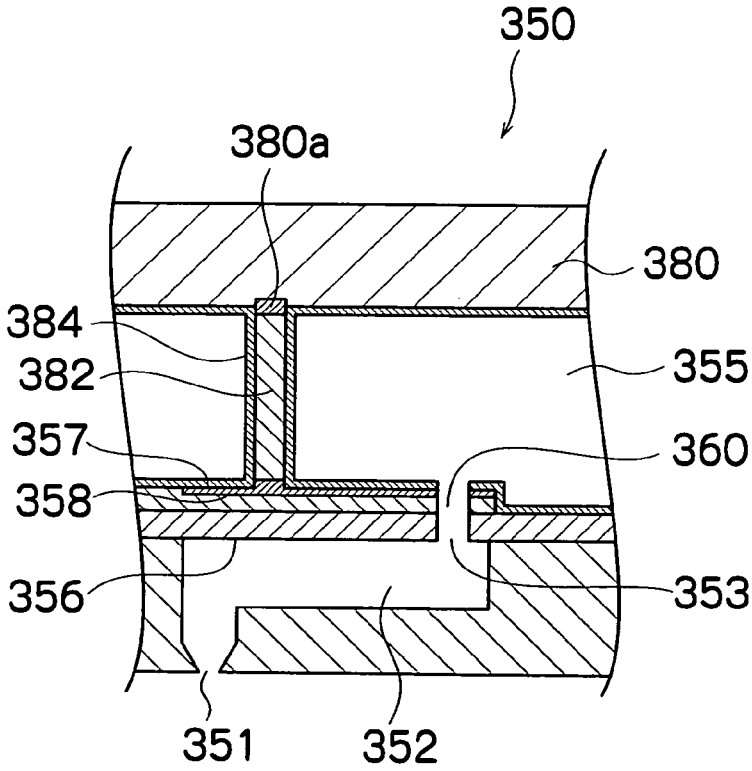
FIG. 12 is an enlarged cross-sectional diagram showing a print head according to a fourth embodiment of the present invention.

FIG. 12 is an enlarged cross-sectional diagram showing a print head 350 according to the fourth embodiment of the present invention.

As shown in FIG. 12, as distinct from the first to third embodiments described above, in the print head 350 according to the present embodiment, a common liquid chamber 355 is positioned directly above pressure chambers 352, a wiring layer is positioned above same, and wires (electrical columns) 382 are formed by passing through a common liquid chamber 355 so as to rise up perpendicularly from each of individual electrodes 357 to the wiring layer. In this case, as similar to the first to third embodiments described above, an ink supply path is also formed so as to pass through a piezoelectric element 358 and a diaphragm 356 in the active section of the piezoelectric element 358.

The pressure chamber 352 is connected to a nozzle 351 at the end of the lower surface thereof, and has an ink supply port 353 at the end of the upper surface thereof. When viewed from above, the planar shape of the pressure chamber 352 is substantially a square shape. While the nozzle 351 is formed in the vicinity of one end on a diagonal line of the pressure chamber 352, the ink supply port 353 is formed in the vicinity of another end on the diagonal line.

The upper surface of the pressure chamber 352 on the side opposite to the nozzle 351 is constituted by the diaphragm 356, and the diaphragm 356 also serves as a common electrode. The piezoelectric element 358 is bonded on top of the diaphragm 356, and the individual electrode 357 is formed on the upper surface of the piezoelectric element 358. The common liquid chamber 355 for supplying ink to the pressure chamber 352 is formed onto the upper side of the diaphragm 356 on which the piezoelectric element 358 is bonded. A multi-layer flexible cable 380 is positioned as a wiring layer on the upper side of the common liquid chamber 355 (in other words, on the portion forming the ceiling of the common liquid chamber 355).

The ink supply port 353 is formed inside an active section of the piezoelectric element 358, and an ink supply channel 360 connected directly to the common liquid chamber 355 is formed perpendicularly to the diaphragm 356 so as to pass upward from the ink supply port 353 and through the diaphragm 356 and the piezoelectric element 358.

Furthermore, an electrical wire 382 for supplying a drive signal to the individual electrode 357 from the multi-layer flexible cable 380 is formed perpendicularly to the diaphragm 356 (piezoelectric element 358) between the multi-layer flexible cable 380 and the individual electrode 357, passing through the common liquid chamber 355.

The electrical wire 382 having a column shape is formed inside the common liquid chamber 355 on the individual electrode 357, and is also called an "electrical column" due to its shape, hereinafter. The position at which the electrical wire (electrical column) 382 is provided is not limited in particular, and may be a suitable position on the individual electrode 357. Also, the electrical wire (electrical column 382) may be erected on an electrode pad which is formed on the partition of the pressure chambers 352 by extracting the individual electrode 357 or extracting an electrode provided in the individual electrode 357.

The electrical wires 382 are connected to the multi-layer flexible cable 380 via the electrode pads 380*a*, and are connected to respective wires (not shown) in the multi-layer flexible cable 380, thereby supplying drive signals for driving the respective piezoelectric elements 358 via the respective electrical wires 382.

Furthermore, since ink is filled into the space that the electrical wires (electrical columns) 382 are formed between the diaphragm 356 bonded with the piezoelectric elements 358 and the common liquid chamber 355, an insulating and protective film 384 is formed on the surfaces of the sections which make contact with the ink.

As described above, the ink supply channels 360 which supplies the ink from the common liquid chamber 355 to the pressure chambers 352 are formed as ink columns which pass perpendicularly through the piezoelectric elements 358 and the diaphragm 356, and the electrical wires 382 which supply drive signals to the individual electrodes 357 are formed as electrical columns which are erected perpendicularly inside the common liquid chamber 355. Therefore, since the distance between the pressure chambers 352 can be shortened, then it is possible to achieve yet higher density.

Figure 13A:
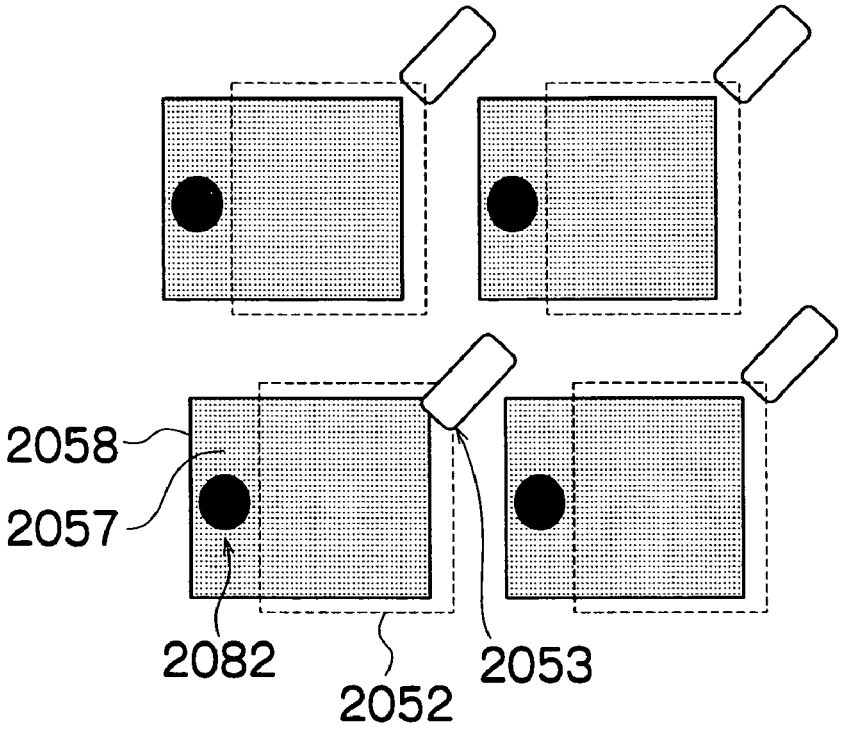
FIGS. 13A and 13B are diagrams for illustrating beneficial effects of the fourth embodiment, FIG. 13A being a partially enlarged view showing a comparative example of the print head, and FIG. 13B being a partially enlarged view of the print head according to the fourth embodiment.
Figure 13B:
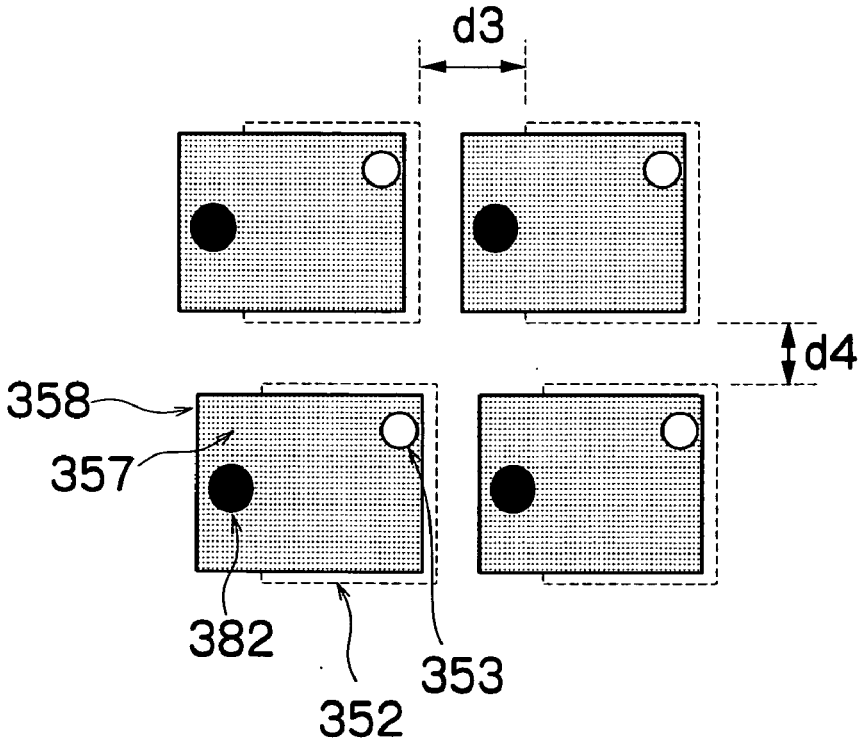

Those beneficial effects of the present embodiment are described concretively with reference to FIGS. 13A and 13B. FIG. 13A shows a case that the ink supply ports 2053 are provided outside the pressure chambers 2052 as in the prior art, though electrical wires 2082 are formed as electrical columns. On the other hand, FIG. 13B shows a case that ink supply channels 360 are formed as ink columns according to the present embodiment, that ink supply ports 353 are provided in the active sections of the piezoelectric elements 358 (inside the individual electrodes 357), and that electrical wires 382 are disposed as electrical columns on the individual electrodes 357.

Even when the electrical wires 2082 are formed as electrical columns as shown in FIG. 13A, it needs to allocate corresponding installation space in order to form the ink supply ports 2053 inside the partitions to the outer side of the pressure chambers 2052, and therefore, it is difficult to achieve higher density.

On the other hand, as shown in FIG. 13B, if the ink supply channels 360 are formed as ink columns while the electrical wires 382 are formed as electrical columns, then the space of the supply channels is reduced. Therefore, both of the lateral distances d3 and d4 between the pressure chambers 352 can be reduced, and yet higher density can be achieved. Furthermore, for example, "sensor columns" may be disposed in the remaining sections on the partitions, which are formed by wires for extracting signals from sensors which determine the ejection state is determined by measuring the ink pressure inside the pressure chambers, and then the wires may be formed in the shape of perpendicular columns as similar to the electrical wires 382.

In this way, according to the present embodiment, since electrical wires 382 are formed perpendicularly on the individual electrodes 357, in addition to forming ink supply channels 360 passing perpendicularly through the active sections of the piezoelectric elements 358 and the diaphragm 356, then it is possible to effectively use the surface area above the partitions between the pressure chambers 352, and hence yet higher density can be achieved. Furthermore, since the rigidity of the partitions is increased and high-speed ejection of ink and high-speed refilling becomes possible, high-frequency driving can be achieved.

As described above, according to the first to fourth embodiments, a portion of the active section in each of the piezoelectric elements is used as an ink supply port, and an ink supply channel (ink column) which directly connects the common liquid chamber and the pressure chamber is formed passing through the piezoelectric element and the diaphragm. Therefore, the ink ejection speed and refilling characteristics can be improved, and high-frequency driving (high-frequency ejection) becomes possible.

Furthermore, by a structure adopting in which the ink supply channels are formed as ink columns passing through the piezoelectric elements and the diaphragm, it is possible to make effective use of the surface area above the pressure chamber partitions. Therefore, the rigidity of the partitions can be increased while also enabling high-frequency ejection. Moreover, when adopting a structure in which the electrical wires are formed as electrical columns which pass through the common liquid chamber, it is possible to achieve yet higher density.

The liquid ejection head and the image forming apparatus according to the present invention have been described in detail above, but the present invention is not limited to the aforementioned examples, and it is of course possible for improvements or modifications of various kinds to be implemented, within a range which does not deviate from the essence of the present invention.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. A liquid ejection head, comprising:

a nozzle which ejects a liquid;

a pressure chamber which is connected to the nozzle;

a common liquid chamber which supplies the liquid to the pressure chamber;

a piezoelectric element which causes the pressure chamber to deform;

a wiring space provided between the piezolectric element and the common liquid chamber; and a liquid supply channel which connects between the common liquid chamber and the pressure chamber, wherein the liquid supply channel passes through the wiring space and an active section of the piezoelectric element.

2. The liquid ejection head as defined in claim 1, wherein:

the piezoelectric element is formed on a surface of the pressure chamber opposite to a side adjacent to the nozzle; and the common liquid chamber is disposed on an opposite side to the pressure chamber with respect to the piezoelectric element.

3. The liquid ejection head as defined in claim 1, wherein at least a portion of the liquid supply channel is constituted by at least one of a bendable member and an elastic member.

4. the liquid ejection head as defined in claim 1, wherein the liquid supply channel includes a bellows-shaped section in a central portion of the liquid supply channel.

5. A liquid ejection head, comprising: a nozzle which ejects a liquid; a pressure chamber which is connected to the nozzle; a common liquid chamber which supplies the liquid to the pressure chamber; a piezoelectric element which causes the pressure chamber to deform; a liquid supply channel which connects between the common liquid chamber and the pressure chamber and a wire which supplies a signal for driving the piezoelectric element and an insulating and protective film on the wire, wherein the liquid supply channel passes through an active section of the piezoeletric element, and the wire has a column shape, and is erected so as to pass through the common liquid chamber in a perpendicular direction with respect to the piezoeletric element and to be encircled on all sides by the liquid in the common liquid chamber.

6. An image forming apparatus, comprising a liquid ejection head which comprises:

a nozzle which ejects a liquid; a pressure chamber which is connected to the nozzle;

a common liquid chamber which supplies the liquid to the pressure chamber;

a piezoelectric element which causes the pressure chamber to deform;

a wiring space provided between the piezolectric element and the common liquid chamber; and a liquid supply channel which connects between the common liquid chamber and the pressure chamber, wherein the liquid supply channel passes through the wiring space and an active section of the piezoelectric element.

7. The image forming apparatus as defined in claim 6, wherein:

the piezoelectric element is formed on a surface of the pressure chamber opposite to a side adjacent to the nozzle; and the common liquid chamber is disposed on an opposite side to the pressure chamber with respect to the piezoelectric element.

8. The image forming apparatus as defined in claim 6, wherein at least a portion of the liquid supply channel is constituted by at least one of a bendable member and an elastic member.

9. The image forming apparatus as defined in claim 6, wherein

The liquid supply channel includes a bellows-shaped section in a central portion of the liquid supply channel.

10. An image forming apparatus, comprising a liquid ejection head which comprises: a nozzel which ejects a liquid; a pressure chamber which is connected to the nozzle; a common liquid chamber which supplies the liquid to the pressure chamber; a piezoelectric element which causes the pressure chamber to deform; a liquid supply channel which connects between the common liquid chamber and the pressure chamber and a wire which supplies a signal for driving the piezoelectric element and an insulating and protective film on wire, wherein the liquid supply channel passes through an active section of the piezoelectric element, and the wire has a column shape, and is erected so as to pass through the common liquid chamber in a perpendicular direction with respect to the piezoeletric element and to be encircled on all sides by the liquid in the common liquid chamber.

* * * * *